United States Patent [19]

Kolkka

[11] 4,044,755

[45] Aug. 30, 1977

[54] ROCK HEATER FOR SAUNA

[76] Inventor: Toivo I. Kolkka, 1175 Shasta, Redwood City, Calif. 94063

[21] Appl. No.: 585,613

[22] Filed: June 10, 1975

[51] Int. Cl.[2] ..... F24H 1/34

[52] U.S. Cl. ..... 126/344

[58] Field of Search ..... 126/344; 128/367; 4/160

[56] References Cited

U.S. PATENT DOCUMENTS

| | | | |
|---|---|---|---|
| 1,857,024 | 5/1932 | Hulme | 126/344 |
| 3,151,615 | 10/1964 | Siniaho | 126/344 |

FOREIGN PATENT DOCUMENTS

| | | | |
|---|---|---|---|
| 473,556 | 5/1951 | Canada | 126/344 |
| 28,254 | 1956 | Finland | 126/344 |
| 36,563 | 1967 | Finland | 128/367 |

*Primary Examiner*—John J. Camby
*Assistant Examiner*—Larry I. Schwartz

[57] ABSTRACT

An improved rock heater having a hollow housing provided with a dome-shaped, heat conductive top and means therewithin for creating combustion gases. Means of heat conductive material is provided adjacent to the top for retaining a pile of rocks to be heated on the top, said retaining means having a fluid passage in fluid communication with the housing so that rising combustion gases, after heating the top, will pass into and through the retaining means. Thus, the heat energy from the top and retaining means will heat the rocks. Flue means coupled with the retaining means directs the combustion gases away from the housing. A shield surrounds the housing.

12 Claims, 4 Drawing Figures

ROCK HEATER FOR SAUNA

This invention relates to improvements in the heating of rocks for saunas and the like and, more particularly, to an improved sauna rock heater.

BACKGROUND OF THE INVENTION

In the construction of sauna rock heaters of the type which generate combustion gases by the burning of wood, natural gas and the like, it is the general practice to support a pile of rocks in a pan-like structure of heat conductive material to present a relatively large heat-transfer surface area to the rocks yet to properly support the rocks. However, when such a structure is used, water, when poured on the heated rocks, oftentimes accumulates in the bottom of the structure and this tends to cause thermal shock in the same which, over extended periods of time, will eventually cause rupture of the pan-like structure, thereby allowing water to fall onto the source of the combustion gases therebelow. When this occurs, the structure must be removed or otherwise repaired before the rock heater can properly be used thereafter. Thus, to avoid the structural damage mentioned above, a need has arisen for an improved rock heater which prevents the accumulation of water in the pan-like structure described with respect to conventional gas-operated or wood-burning rock heaters.

SUMMARY OF THE INVENTION

The present invention fulfills the above-mentioned need by providing a rock heater which not only properly supports a pile of rocks to permit rapid heat transfer thereto but also avoids any accumulation of water on the rock heater in any way to thereby minimize the possibilities of thermal shock which would damage the rock heater in its rock support. To this end, the rock heater of this invention has a housing of heat conductive material, such as sheet or the like. The housing has a dome-shaped top which is substantially convex in all directions. A rock retainer of heat conductive material is coupled to the housing adjacent to the top and operates to confine a pile of rocks to be heated on the top itself. The retainer has portions spaced from the top to allow water to pass therebetween and also has a fluid passage therethrough which communicates with the housing. Combustion gases generated in the housing near the lower end thereof can then rise to contact and heat the top, then can flow into and through the retainer to heat it also. Then, the gases can flow out of the retainer through flue means associated therewith.

An outer portion of the pile of rocks is in contact both with the top and with the retainer, heat is conducted to this outer portion and then transferred by conduction to the rocks on the inner portion of the pile. Heat energy is also transferred from the top and from the retainer by convection and radiation. When water is poured onto the rocks, the water will pass downwardly through the rock pile and any excess water striking the top will immediately gravitate along the same and off the top because the latter has the dome-shaped or convex configuration in all directions. This will assure there will be no accumulation of water on the top for any extended period of time so that thermal shocks will not be developed which would structurally damage the top.

The water gravitating off the top falls downwardly along the housing. The rock heater has an external shield surrounding the housing so that the gravitating water will carom off the shield and be reflected back toward the sidewall of the housing. The heat of the sidewall will vaporize the water before it reaches the bottom of the housing so that there will be substantially no accumulation of water beneath the housing.

The primary object of this invention is, therefore, to provide an improved rock heater for a sauna wherein the rock heater is constructed to eliminate any accumulation of water on the rock supporting portion thereof so as to avoid thermal shocks and resulting structural damage caused by such shocks.

Another object of this invention is to provide a rock heater of the type described wherein the heater has an improved housing provided with a dome-shaped top having a rock retainer associated therewith so that a pile of rocks on the top and confined thereto by the retainer will vaporize water poured onto the rocks and any excess water striking the top will flow downwardly by gravity therefrom.

Other objects of this invention will become apparent as the following specification progresses, reference being had to the accompanying drawings for an illustration of the invention.

Figure 3:
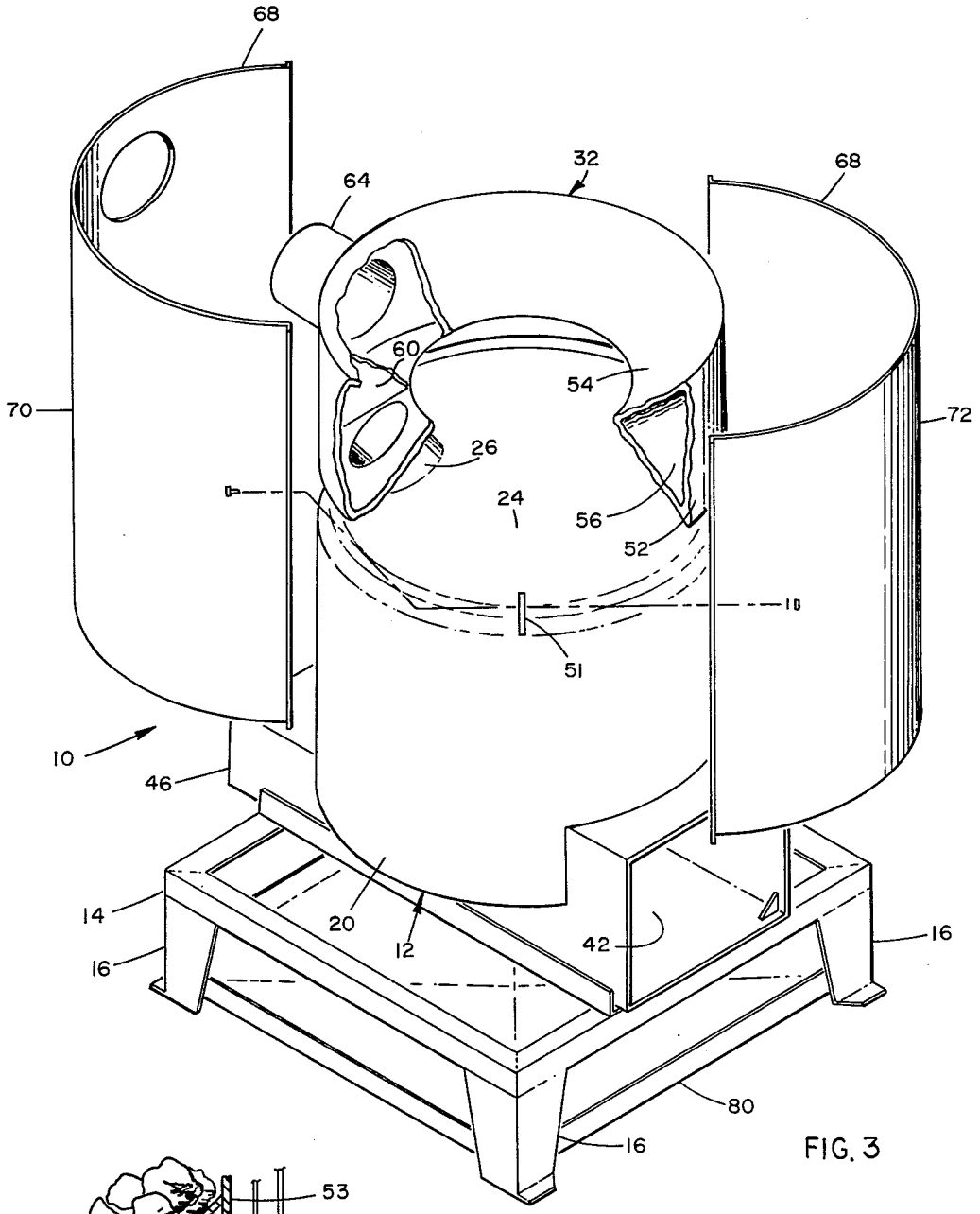
FIG. 3 is a side elevational view, partly in section, of the rock heater.

The rock heater of this invention is broadly denoted by the numeral 10 and includes a first, inner housing 12 mounted on a base 14 having four legs 16 for positioning the rock heater on a flat surface or floor 18. Housing 12 is of heat conductive material, such as sheet steel and has a cylindrical sidewall 20, a bottom 22, and a top 24 integral with sidewall 20. Top 24 slopes downwardly in all directions from its highest point or upper extremity and as it approaches its outer periphery which is secured to or integral with the upper margin of sidewall 20. Thus, top 24 can be of any shape so long as it meets this criterion. For purposes of illustration, it is dome-shaped or convex. The convex nature of top 24 continues uninterruptedly in all directions except for the presence of an inclined, short pipe 26 welded to and surrounding a flue opening 28 (FIG. 3) in top 24 as shown in FIG. 3. Also, the top has a relatively smooth upper surface. Thus, water gravitating onto top 24 will immediately run down the top because of the convex nature thereof. The water will then fall along sidewall 20.

The lower space in housing 12 presents a chamber 30 where combustion gases can be generated. When generated, the gases will rise by convection and will contact and heat top 24; then they will pass outwardly through pipe 26 and into and through a rock retainer 32 hereinafter described.

Figure 2:
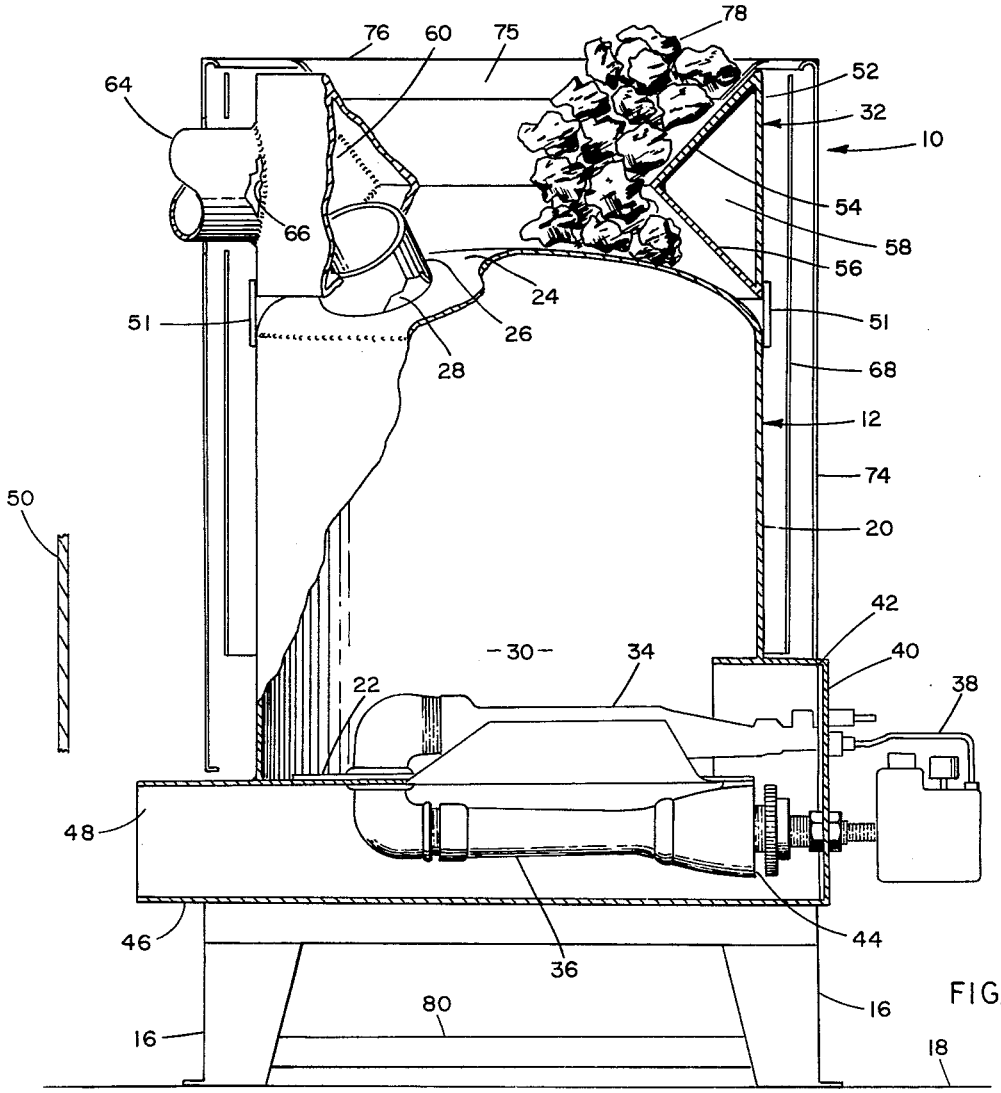
FIG. 2 is a top plan view, partly in section, of the rock heater.

The combustion gases can be generated in any suitable manner, such as by the burning of natural or other gases or oil, or by wool or other combustible products. For purposes of illustration, a gas burner 34 is shown in FIGS. 2 and 3, the burner having an air-gas inlet pipe 36 and external control means 38 adjacent to a panel 40 closing an opening 42 near the bottom of housing 12 and in base 14 so that burner 34 and pipe 36 can be inserted as a unit into the operative position of FIG. 3. Bottom 22 is made to accommodate this burner unit.

Air is supplied to the air entrance end 44 of pipe 36 by an air conduit 46 having an air entrance end 48 which can be connected in any suitable manner to the region surrounding the enclosure or sauna in which rock heater 10 is disposed. Typically, rock heater 10 will be adjacent to a wall 50 of a sauna, the wall being shown fragmentarily in FIG. 3 to illustrate the proximity of the rock heater to the wall. In such a case, the wall will have an opening therethrough and an extension will be provided on conduit 46 which will extend through the opening in the wall. In this way, the air for combustion purposes will be delivered from a region externally of the sauna rather than from internally thereof, it being clear that panel 40 is sufficiently airtight to prevent air from the region adjacent to control means 38 from passing into air inlet 44 of pipe 36.

Rock retainer 32 is spaced slightly above top 24 as shown in FIG. 3 and is coupled to housing 12 by two or more short, rigid straps 51 (FIG. 3), whereby rock retainer 32 is fixed in place relative to housing 12.

Retainer 32 is circular in configuration and has a triangular cross section as shown in FIG. 3. This cross section is formed by an outer, annular, upright band 52, an upper, inclined band 54, and a lower, inclined band 56. Bands 52, 54 and 56 are secured together, such as by welding, to present an airtight fluid passage 58 within rock retainer 32.

Pipe 26 is welded or otherwise secured by an airtight connection to band 56 as shown in FIG. 3, so that pipe 26 is in fluid communication with passage 58. This passage is blocked by a rigid, triangular panel 60 (FIGS. 2 and 3) welded to bands 52, 54 and 56 and disposed adjacent to the upper, open end of pipe 26. Thus, combustion gases rising through housing 12 will pass by convection into the through pipe 26 and then into passage 58. The gases will then flow in a counterclockwise sense when viewing FIG. 2 through passage 58 and exit therefrom through a slightly inclined flue 64 welded of otherwise secured to band 52 and surrounding and extending away from an opening 66 (FIG. 3) therein. The gases can then rise by convection through a vertical flue pipe in a conventional manner.

Figure 1:
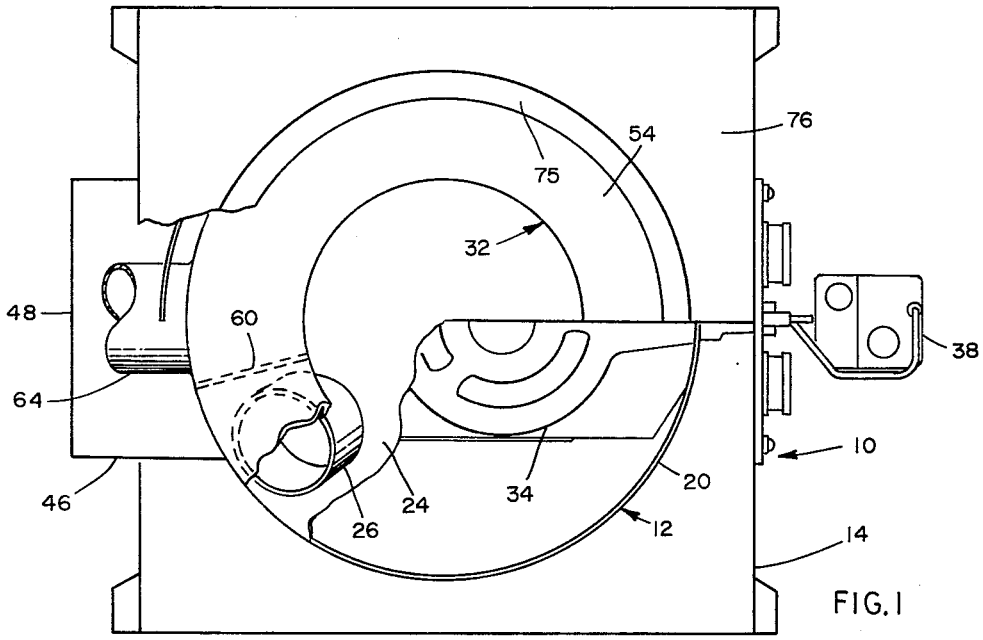
FIG. 1 is a perspective view of the rock heater of this invention, parts being broken away and separated from each other to illustrate details of construction.

The rock heater further includes a cylindrical shell 68 (FIG. 3) of thin, metallic material which substantially surrounds housing 12 and rock retainer 32 and is spaced therefrom. Shell 68 can be formed of a pair of semicylindrical segments 70 and 72 as shown in FIG. 1 and supported in any suitable manner on base 14. This is for the purpose of simplifying the assembly of the rock heater. An outer, decorative housing 74 is provided for the rock heater, the housing 74 being illustrated as square in configuration although any other configuration can be used. As shown, housing 74 is comprised of four flat panels interconnected in any suitable manner. A perforated top panel 76 is removably placed over the upper end of housing 74. Panel 76 has an annular, inclined lip 75 defining a central opening surrounding and adjacent to the outer periphery of rock retainer 32.

A plurality of rocks 78 (FIG. 3) are piled on top 24 and in the region surrounded by retainer 32. Typically, band 56 is spaced slightly above top 24 as shown in FIG. 3 and the sizes of the rocks 78 are such that they are effectively retained substantially in all spaces between top 24 and band 56 and on the central portion of the pile. Also, the rocks are in contact with the upper surface of band 54 and the pile of rocks generally extends above the horizontal plane of top panel 76 as shown in FIG. 3.

In operation, combustion gases are generated in chamber 30. For instance, if burner 34 is used, the combustion gases are created by the burning of natural or any other gas in region 30. The combustion gases rise and contact top 24 which is heated because it is of heat-conductive material. The heat energy absorbed by the top is transferred by conduction and radiation to the rocks in contact therewith and these rocks, in turn, propagate their heat energy to adjacent rocks. The combustion gases then pass through pipe 26 and then into and through passage 58. The combustion gases travelling through passage 58 also heat bands 54 and 56, and these bands, therefore, transfer their heat energy by conduction and radiation to the rocks adjacent thereto. The other rocks piled on the rocks in contact with bands 54 and 56, therefore, receive heat energy by conduction, radiation and convection.

The combustion gases travel substantially completely through passage 58 since panel 60 blocks the direct communication between pipe 26 and flue 64. The combustion gases, therefore, substantially heat all of the rocks in contact with band 54 and 56 before the gases pass out of the passage 58 through flue 64.

During use of the rock heater and after the rocks become sufficiently hot, water is periodically poured onto the heated rocks. The water will generally vaporize immediately; however, some of the water may pass through the rocks and gravitate onto top 24. While the heated top 24 will immediately vaporize some of the water falling on it, that portion of the water not vaporized will gravitate along the top and down the same toward sidewall 20 thereof because of the convex or domed shape of top 24. Thus, there will be no accumulation of water on top 24 at any time and this assures that there will be no thermal shocks associated with the top which would eventually fatigue the metal thereof and cause it to rupture or otherwise become damaged. The water rolling or moving downwardly over top 24 will move off the top and carom off shell 68 and will then be redirected onto sidewall 12 a number of times until the heat of the sidewall vaporizes such gravitating water. To avoid an excessive accumulation of water on surface 18, a collection pan 80 is provided below base 14 within legs 16 thereof.

Figure 4:
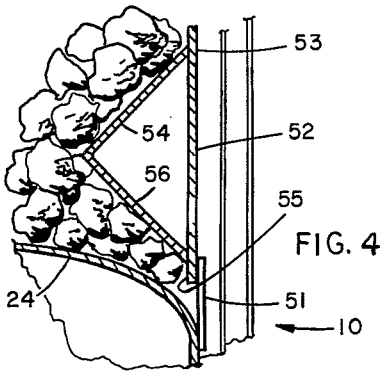
FIG. 4 is a fragmentary, cross-sectional view of another embodiment of the rock retainer of the rock heater of this invention.

It may be desirable to increase the space between top 24 and lower band 56 of retainer to thereby permit more rocks to be used with rock heater 10. This increases the heat capacity of the rock heater and can be used to heat larger saunas. In this case, rigid strips 51 are longer and outer band 52 is provided with an upper annular extension 53 and a lower, annular skirt 55, both the extension and the skirt being provided to retain the upper and lower portions of the rock pile on top 24 as shown in FIG. 4.

That which is claimed is:

1. In a rock heater: a housing of heat-conductive material, said housing being provided with a top and having a chamber below the top in which combustion gases can be generated, said top having an upper extremity and sloping downwardly and outwardly from said upper extremity in substantially all directions; means having a fluid passage therethrough and disposed adjacent to the top for retaining a pile of rocks thereon; and a pipe placing said fluid passage in fluid communication with said housing for permitting combustion gases to flow out of the housing and into the fluid passage, the latter having a fluid outlet for the exhausting of gases therefrom.

2. In a rock heater as set forth in claim 1, wherein said pipe is inclined and extends upwardly and outwardly from said top.

3. In a rock heater as set forth in claim 1, wherein said pipe is connected to said retaining means at a first location thereon, said gas outlet being at a second location on the retaining means, said second location being in proximity to the first location, there being a flue secured to and extending outwardly from said retaining means at said second location, said flue being in fluid communication with said fluid passage, and including means proximal to and between said first and second locations for blocking said fluid passage, the remainder of said fluid passage being unobstructed.

4. In a rock heater as set forth in claim 1, wherein said housing has a cylindrical sidewall, said retaining means including an annular, heat-conductive rock retainer provided with a central, rock-receiving opening, there being means mounting said retainer on the housing above said top.

5. In a rock heater as set forth in claim 1, wherein said rock retainer includes a first annular, outer band, a second annular, upper band, and a third annular, lower band, said bands being secured together to form said fluid passage.

6. In a rock heater as set forth in claim 5, wherein said flow permitting means includes a pipe spanning the distance between said top and said lower band and placing said fluid passage in fluid communication with said housing, there being a flue secured to and extending outwardly from said outer band and being in fluid communication with said fluid passage, said fluid being in proximity to said pipe, and a panel secured to said bands in blocking relationship to said fluid passage at a location in proximity to and between said pipe and said flue.

7. In a rock heater as set forth in claim 1, wherein said housing has a cylindrical sidewall provided with upper and lower margins, said top being secured to the upper margin, said sidewall having an opening near its lower margin for admitting means for generating combustion gases in said chamber.

8. In a rock heater as set forth in claim 1, wherein said top is dome-shaped.

9. In a rock heater as set forth in claim 1, wherein said top has a generally convex upper surface.

10. A rock heater comprising: a housing of heat conductive material, said housing including a continuous sidewall, a bottom and a top, said top having an upper extremity and sloping downwardly from said upper extremity in substantially all directions; a rock retainer; means mounting said rock retainer on said housing above and spaced from said top, said rock retainer having a fluid passage therethrough; means placing said housing in fluid communication with said fluid passage; means in said housing near the bottom thereof for generating combustion gases therein; and fluid means in fluid communication with said fluid passage for permitting combustion gases to be exhausted therefrom.

11. A rock heater as set forth in claim 10, wherein said rock retainer has an outer, annular band, and a pair of annular, inclined bands secured to and extending inwardly of said outer band, the inner peripheries of the inclined bands being coupled together, said outer band having an upper, annular extension and a lower, annular skirt.

12. In a rock heater: a housing of heat conductive material, said housing having a top and a chamber below the top in which hot gases can be generated, said top having an upper extremity and sloping downwardly and outwardly from said upper extremity in substantially all directions; a tubular rock retainer having a central rock-receiving hole therethrough and being in fluid communication with said housing to receive hot gases therefrom; means coupled with the housing for mounting the rock retainer in spaced relationship above said top, whereby rocks placed on said top through said central hole of the rock retainer will be retained in place on the top, at least the major portion of the outer periphery of the top being free of attached structure to permit water to gravitate from the top past said major portion; a shield surrounding the housing to intercept water gravitating from the top; and means coupled with the retainer for permitting hot gases to flow out of the same.

* * * * *